US006951106B2

(12) United States Patent
Raiko

(10) Patent No.: US 6,951,106 B2
(45) Date of Patent: Oct. 4, 2005

(54) INTEGRATION CONSTRUCTION BETWEEN A BOILER AND A STEAM TURBINE AND METHOD IN PREHEATING OF THE SUPPLY WATER FOR A STEAM TURBINE AND IN ITS CONTROL

(75) Inventor: Markku Raiko, Hyvinkää (FI)

(73) Assignee: Fortum Oyj, Espoo (FI)

( * ) Notice: Subject to any disclaimer, the term of this patent is extended or adjusted under 35 U.S.C. 154(b) by 0 days.

(21) Appl. No.: 10/250,322

(22) PCT Filed: Jan. 2, 2001

(86) PCT No.: PCT/FI01/00003

§ 371 (c)(1),
(2), (4) Date: Dec. 4, 2003

(87) PCT Pub. No.: WO02/055846

PCT Pub. Date: Jul. 18, 2002

(65) Prior Publication Data

US 2004/0098987 A1 May 27, 2004

(30) Foreign Application Priority Data

Dec. 29, 2000 (FI) ..... 20002895

(51) Int. Cl.[7] ..... F01K 7/34
(52) U.S. Cl. ..... 60/653; 60/679
(58) Field of Search ..... 60/653, 677, 679

(56) References Cited

U.S. PATENT DOCUMENTS 3,667,217 A 6/1972 Vidal et al. ..... 60/39.02
3,913,330 A 10/1975 Horlitz, Jr. ..... 60/678

(Continued)

FOREIGN PATENT DOCUMENTS

EP 0037845 10/1981
EP 0724683 4/1995
EP 1050667 5/1999

(Continued)

*Primary Examiner*—Hoang Nguyen
(74) *Attorney, Agent, or Firm*—Steinberg & Raskin, P.C.

(57) ABSTRACT

The present invention concerns an integration construction between a steam boiler provided with a combustion chamber and a steam turbine. The steam is conducted from the steam boiler (10) along a connector to the steam turbine (11) for rotating an electric generator (K) producing electricity. The supply water circulated via the steam boiler (10) is vaporized in a vaporizer (190) located in the steam boiler (10) and superheated in a superheater (120). The supply water is conducted into the boiler through an economizer (20) acting as a heat exchanger, where heat is transferred from the flue gases of the boiler into the supply water. The economizer (20) is provided with at least two sections, comprising at least one first economizer section (20*a*1) and at least one second economizer section (20*a*2). The supply water is conducted from the first economizer section (20*a*1) to a supply water preheater formed from a heat exchanger (14), where thermal energy is transferred from bled steams of the steam turbine either directly or via a medium, advantageously water, into the supply water. The supply water preheated with bled steams of the steam turbine is conducted in the steam boiler (10) to the second economizer section (20*a*2) and further to the vaporizer (190) and the superheater (120) and therethrough, in the form of steam, to the steam turbine. In the integration construction, the temperature of the supply water is raised continuously as the supply water is flowing in the first economizer section (20*a*1) and from the first economizer section (20*a*1) to the supply water preheater (14) and threthrough, to the second economizer section (20*a*2). The connector (13*a*1.1) leading to the supply water preheater (14) comprises a valve (21) for controlling the bled-steam.

4 Claims, 1 Drawing Sheet

U.S. PATENT DOCUMENTS

| | | | | | |
|---|---|---|---|---|---|
| 4,173,949 | A | | 11/1979 | Roethe | 122/1 C |
| 4,866,928 | A | * | 9/1989 | Raiko | 60/775 |
| 4,976,107 | A | | 12/1990 | Korpela | 60/670 |
| 5,175,993 | A | * | 1/1993 | Raiko et al. | 60/775 |
| 5,840,130 | A | | 11/1998 | Liebig et al. | 134/22.15 |
| 6,560,966 | B1 | * | 5/2003 | Fetescu et al. | 60/775 |
| 6,813,888 | B2 | * | 11/2004 | Raiko | 60/653 |

FOREIGN PATENT DOCUMENTS

| | | |
|---|---|---|
| EP | 0724683 | 6/2000 |
| FI | 77512 | 11/1988 |
| FI | 101163 | 4/1995 |
| WO | 9511370 | 4/1995 |

* cited by examiner

INTEGRATION CONSTRUCTION BETWEEN A BOILER AND A STEAM TURBINE AND METHOD IN PREHEATING OF THE SUPPLY WATER FOR A STEAM TURBINE AND IN ITS CONTROL

FIELD OF THE INVENTION

The present invention relates to an integration construction between a boiler and a steam turbine and a method in preheating the supply water for a steam turbine and in its control.

BACKGROUND OF THE INVENTION

The last heat face of a steam boiler before the smoke stack is either a flue-gas/air heat exchanger or an economizer. In the present application, a flue-gas/air heat exchanger is understood as a heat exchanger between flue gas and combustion air, in which the heat is transferred from the flue gas into the combustion air to preheat the combustion air. In the present application, an economizer is understood as a heat exchanger in which thermal energy is transferred from the flue gases into the supply water.

When a flue-gas/air heat exchanger is used, the supply water for the boiler can be preheated by means of bled steam from a steam turbine, whereby the efficiency of the steam turbine process is enhanced. A flue-gas/air heat exchanger, i.e. a heat exchanger, in which thermal energy is transferred from the flue gases directly into the combustion air is not usually used in small steam power plants because of its high cost.

When a flue-gas/air heat exchanger is not used, the flue gases of the steam boiler are cooled with the aid of an economizer before passing into the smoke stack. In such case, the supply water cannot be preheated with the aid of bled steam of the steam boiler because the preheating would raise the ultimate temperature of the flue gases and thereby, impair the efficiency of the boiler.

In an economizer of a steam boiler, heat is transferred from the flue gases into the supply water. A steam boiler provided with a combustion chamber is used as the steam boiler. A change in the temperature of the supply water in the economizer is lower than a change in the temperature on the flue-gas side. A temperature rise in the supply water is usually 40 to 50 per cent of the respective the temperature drop on the flue-gas side. Hence, a difference of temperature on the hot end of the economizer is considerably higher than on the cold end. A result of this observation is that, in addition to the heat obtained from the flue gases, different kind of heat can be transferred into the supply water. In a steam turbine process, it is advantageous to utilize bled steam for preheating the supply water.

The economizer of the steam boiler in a steam power plant is divided into two or more parts, the supply water being preheated in the preheaters of the high-pressure side provided between said economizer parts by the bled steam from the steam turbine.

With the aid of a connection, the integration of the steam boiler and the steam turbine process is made more efficient. By means of such arrangement, the flue gases of the steam boiler can be cooled efficiently, and simultaneously enhancing the efficiency of the steam turbine process.

The investment cost is lower than in an alternative provided with a flue-gas/air heat exchanger:

improved controllability and boiler efficiency smaller boiler building lower cost of the boiler.

When a flue-gas/air heat-exchanger solution is unprofitable, an improved process can be implemented with the structure since the use of bled steam can be increased.

The arrangement is preferred especially in an instance in which the combustion air of the steam boiler is heated in one or more steam/air heat exchanger(s) connected in series and utilizing bled steam.

In a prior FI patent No. 101 163, which corresponds to EP 0724683, of the applicant, the advantageous integration construction between the steam boiler and the steam turbine is known. It has proved to be useful that the temperature of the supply water flown through the economizers positioned in the flue-gas duct can be controlled. An amendment to the integration construction disclosed in the FI patent No. 101 163 is presented in the present application.

OBJECTS AND SUMMARY OF THE INVENTION

It is disclosed in the present application that by limiting the amount of bled steam of the preheater in the divided economizer, the integration degree of the steam turbine process can be controlled. The preheating is limited by the boiling temperature of the hottest economizer, and the lower limit is the closing of the bled. The method of control exerts an efficient impact on the electricity production but it slightly deteriorates the efficiency of the boiler when the bled steam use exceeds the scheduled value. A change in the degree of integration is of the order 10%. A change in the efficiency of the boiler is 2 to 3% at most.

By controlling the temperature of the supply water flowing through the economizer it is possible (a) to control the ultimate temperature of the flue gas of the boiler as the power of the boiler changes and as the quality of the fuel varies (b) to control the ultimate temperature of the supply water so that the ultimate temperature of the supply water after the economizer is as desired (being e.g. 10 to 20° C. below the boiling temperature).

Particularly when a soda recovery boiler is in question, the flue gases are highly soiling and corroding, and therefore, the soda recovery boilers cannot be provided with a flue-gas/air heat exchanger. The flue gases of the boiler are cooled by supplying supply water at about 120° C. into the boiler. The preheating of the combustion air is important because of the combustion of black lye and therefore, the combustion air is heated with the aid of plant steam, typically to about 150° C.

The above integration is not optimal considering the steam turbine process and therefore, the electricity power obtained from a back-pressure turbine remains low. As regards the boiler, an optimal situation prevails when the temperature of the flue gases exiting the boiler is as low as possible and no excessive soiling and corrosion of the heat faces is taking place yet. When the supply water supplied into the boiler is in a constant temperature, the temperature of the flue gases varies in accordance with the power level, quality of fuel and the soiling situation of the heat faces. An optimal temperature is reached only momentarily by partial power ratios.

As described above, the optimal manner of running the boiler is reached by integrating the soda recovery boiler and steam turbine process as follows. The combustion air is preheated, instead of the plant steam, with bled steams of the steam turbine to about 200° C., and between the economizers in the flue-gas duct of the boiler, a supply water preheater utilizing bled steam is positioned. By controlling the temperature of the supply water entering into the boiler with the aid of the amount of bled steam entering into the preheater, the ultimate flue-gas temperature of the boiler can be controlled as desired in all running situations.

The integration construction between a steam boiler and a steam turbine of the invention and the method in preheating the supply water of the steam turbine and in its control is characterized in what is presented in the claims.

BRIEF DESCRIPTION OF THE DRAWINGS

The invention is described below referring to the advantageous embodiments of the invention illustrated in the drawings of the accompanying figures, whereto, however, the invention is not intended to be exclusively confined.

DETAILED DESCRIPTION OF THE INVENTION

Figure 1:
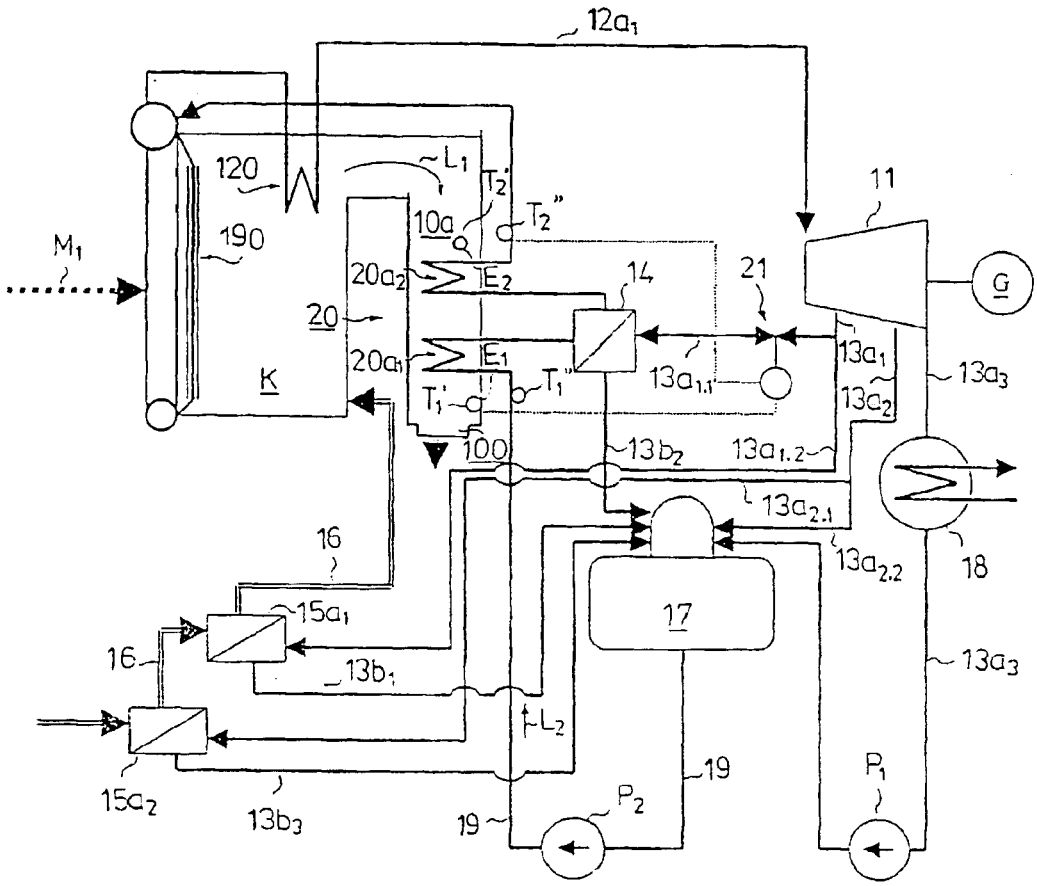
FIG. 1 presents as a schematic diagram an integration construction between a boiler and a steam turbine.

FIG. 1 presents an integration construction of the invention between a steam boiler and a steam turbine, comprising a steam boiler, such as soda recovery boiler, to which fuel is brought as shown by arrow $M_1$. The boiler is indicated by reference numeral 10. The evaporator is indicated by reference numeral 190 and the superheater thereafter in a connector 12$a_1$ by reference numeral 120. The flue gases are discharged during a second draught 10*a* from the boiler 10 through a smoke stack 100 into the outside air as shown by arrow $L_1$. The second draught 10*a* is the part of the boiler which comprises heat faces prior to the smoke stack 100. Superheated steam is conducted to the steam turbine 11 along the connector 12$a_1$ and the steam turbine 11 is arranged to rotate a generator G producing electricity. From the steam turbine 11, connectors 13$a_1$ and 13$a_2$ are provided for bled steams and a connector 13$a_3$ into a condensator for exit steams or back-pressure steam travelling into an industrial process. The connector 13$a_1$ is branched into branch connectors 13$a_{1.1}$ and 13$a_{1.2}$, of which the connector 13$a_{1.1}$ conducts to a preheater 14 of the supply water running in the connector 19 and the connector 13$a_{1.2}$ conducts to a preheater 15$a_1$ of the combustion air which is provided with a return connector 13$b_1$ to the supply water tank 17. From the supply water preheater 14, a return connector 13$b_2$ is provided into the supply water tank 17. The combustion air is conducted along a connector or an air duct 16 via combustion air preheaters 15$a_1$ and 15$a_2$ positioned in series in the combustion chamber K of the boiler 10.

In the integration construction, the temperature of the supply water is continuously raised when it is flowing in a first economizer section 20$a_1$ and from the first economizer section 20$a_1$ to the supply water preheater 14 and therethrough to a second economizer section 20$a_2$. In the preheater 14, the supply water is heated with the aid of thermal energy obtained from bled steams.

From the steam turbine 11, a connector 13$a_2$ is furthermore provided for bled steam, which is branched into branch connectors 13$a_{2.1}$, 13$a_{2.2}$. The connector 13$a_{2.1}$ leads to a second combustion air preheater 15$a_2$. From the air preheater 15$a_2$, a discharge connector 13$b_3$ is provided to the supply water tank 17. The connector 13$a_{2.2}$ leads to the supply water tank 17. The discharge steam connector 13$a_3$ of the steam turbine 11 is lead to a condensator 18. On the outlet side of the condensator 18, the connector 13$a_3$ is provided with a pump $P_2$ to pump water into the supply water tank 17 from the condensator 18.

A pump $P_2$ is connected to a connector 19 leading from the supply water tank 17 to a first economizer section 20$a_1$ of the economizer 20 in the flue-gas duct 10*a*, said first economizer section being further connected to a second economizer section 20$a_2$, which economizer sections 20$a_1$ and 20$a_2$ are in this manner in series in relation to each other and between which economizer sections 20$a_1$ and 20$a_2$, a preheater 14 is located to transfer the energy from the bled steam into the supply water. Thus, the economizer 20 is made of at least of two sections, and the first economizer section 20$a_1$, the supply water preheater 14 and the second economizer section 20$a_2$ are connected in series in relation to each other. Thermal energy is transferred in the preheater 14 either directly from the steams into the supply water or indirectly via a medium, for instance water, into the supply water. Therefore, the preheater 14 is a heat exchanger in which thermal energy is transferred into the supply water.

By controlling the amount of bled steam to the preheater 14 with a valve 21, the temperature of the supply water entering into the second economizer section 20$a_2$ can be regulated efficiently in different running conditions of the boiler 10.

Figure 2:
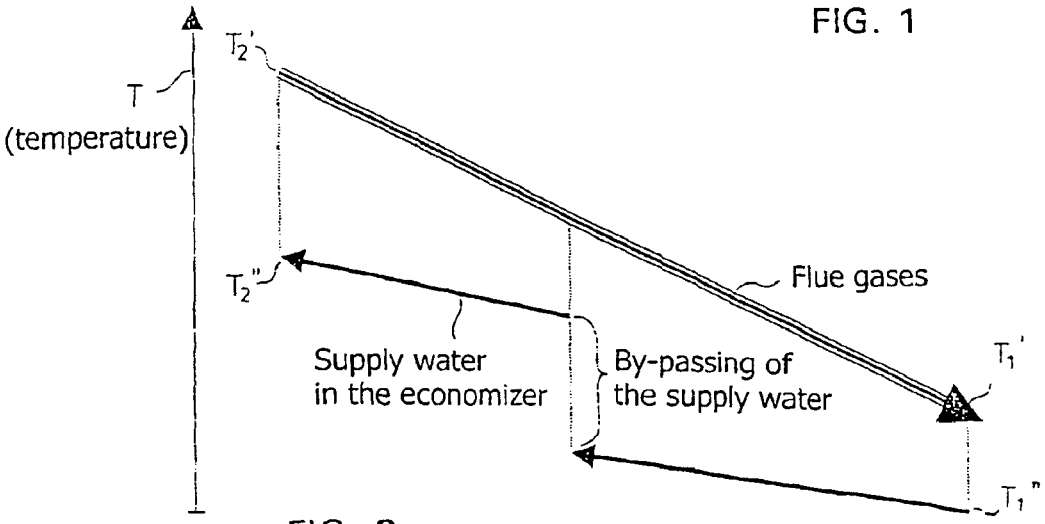
FIG. 2 presents a decrease of the flue-gas temperature in a flue-gas duct and an increase of temperature in the supply water of an economizer in a control of the invention.

As in FIG. 2, the water temperature of the supply water entering into the hot economizer section 20$a_2$ changes due to the control. This affects the cooling power of the flue gases as a result of changed temperature differences in the heat transfer and therethrough, the influence of the control is transmitted to the ultimate temperature of the flue gases. On the inlet side of the economizer section 20$a_1$ and on the outlet side of the flue-gas duct 10*a*, the flue-gas temperature is marked by $T_1'$ and the temperature of the supply water by $T_1''$. On the outlet side of the second economizer section and on the inlet side of the flue-gas duct the markings of FIG. 2 are as follows: the flue-gas temperature is $T_2'$ and the supply water temperature is $T_2''$. The flue-gas duct 10*a* may comprise temperature sensors: a temperature sensor $E_2$ measuring the temperature on the inlet side of the flue-gas duct (when viewed in the flow direction $L_1$ of the flue gas), and a temperature sensor $E_1$ measuring the temperature of the flue gas on the outlet side of the flue-gas duct 10*a*. In addition, the apparatus may comprise temperature sensors in the connector of the supply water. The temperature can be measured from the supply water after the first economizer section 20$a_1$ before the second economizer section 20$a_2$ and from the supply water after the second economizer section 20$a_2$ when viewed in the flow direction $L_2$ of the supply water. The flow direction of the supply water in the connector 19 is marked by arrow $L_2$ in the FIG. 1.

In the method in preheating the supply water of a steam turbine and in its control, the procedure is as follows. The supply water is conducted into an economizer 20 of the steam boiler 10 provided with a combustion chamber K, where heat is transferred in a heat exchanger from the flue gases into the supply water. The economizer 20 is arranged to be positioned, at least in part, on its heat faces in a flue-gas duct 10*a* of the steam boiler 10. At least a two-section economizer 20$a_1$, 20$a_2$ is used for heating the supply water. The first preheating of supply water is carried out with the aid of thermal energy taken from the flue gases of the boiler in the first economizer section 20$a_1$. The second preheating step 14 takes place between the economizer sections 20$a_1$, 20$a_2$, where the preheating of supply water is carried out from bled steams with the aid of thermal energy provided either directly or indirectly. The supply water preheated with the aid of bled steams is conducted into the second economizer section 20$a_2$ and further to a vaporizer 190 and a superheater 120 and further, in the form of steam, to the steam turbine 11 to rotate the electric generator G and to produce electricity. In the method, the temperature of the supply water is raised continuously when it is running in the first economizer section 20$a_1$ and from the first economizer section 20$a_2$ to the preheating section 14, and from said preheating section 14 to the economizer section 20$a_2$, in which the supply water is hotter. In the method, also the combustion air is preheated with the aid of the energy acquired from bled steams. In the method, the bled-steam flow made to flow to the preheater 14 of the supply water is controlled for controlling the temperature of the supply water in the connector 19. The flow quantity of the bled steam in the connector 13$a_{1.1}$ is controlled with a valve 21. The bled-steam flow to the preheater 14 is controlled on the basis of temperature measurements, that is, by measuring the temperature $T_1'$, $T_2'$ of the flue gases made to flow in the flue-gas duct 10$a$ and/or the temperature $T_1''$, $T_2''$ of the supply water in the connector 19.

What is claimed is:

1. An integration construction between a steam boiler and a steam turbine provided with a combustion chamber, comprising:

a connector structured and arranged to conduct steam from the steam boiler(10) to the steam turbine (11) for rotating an electric generator (G) generating electricity, a vaporizer (190) located in the steam boiler (10), said vaporizer (190) is structured and arranged to vaporize a supply water being circulated through the steam boiler (10) and superheated in a superheater (120), an economizer (20) acting as a heat exchanger, in which heat is transferred from the flue gases of the boiler into the supply water, and the supply water is conducted into the boiler through the economizer (20), wherein the economizer (20) is provided with at least two sections, comprising at least one first economizer section (20$a_1$) and at least one second economizer section (20$a_2$), a supply water preheater (14) formed from the heat exchanger, wherein thermal energy is transferred from the bled steams of the steam turbine either directly or via a medium, advantageously water, into the supply water, and wherein the supply water is conducted from the first economizer section (20$a_1$) to the supply water preheater (14), wherein the supply water being preheated with bled steams of the steam turbine is conducted in the steam boiler (10) to the second economizer section (20$a_2$) and further, in the form of steam, to the vaporizer (190) and the superheater (120), and therethrough, to the steam turbine (11), wherein the temperature of the supply water is raised continuously as the supply water is flowing in the first economizer section (20$a_1$) and from the first economizer section (20$a_1$) to the supply water preheater (14) and therethrough to the second economizer section (20$a_2$), wherein another connector (13$a_{1.1}$) leading to the supply water preheater (14) comprises a valve (21) for controlling the bled-steam flow to the preheater (14), wherein the bled steam flow to the preheater (14) is controlled on a basis of the temperature measurements, that is, by measuring a temperature ($T_1'$, $T_2'$) of the flue gases made to flow in a flue-gas duct (10$a$) and/or a supply water temperature ($T_1''$, $T_2''$) in the connector (19).

2. The integration construction according to claim 1, wherein a flow quantity of bled steam to a preheater (14) is controlled with at least one valve (21).

3. A method in preheating of a supply water for a steam turbine and in its control, comprising the steps of:

conducting the supply water into an economizer (20) of a steam boiler (10) provided with a combustion chamber (K), in which heat is transferred in a heat exchanger from the flue gases into the supply water, arranging the economizer (20), by its heat faces, at least partly in a flue-gas duct (10$a$) of the steam boiler (10), wherein the economizer includes at least one first section (20$a_1$) and at least one second section (20$a_2$), said first and second sections (20$a_1$, 20$a_2$) being used for heating the supply water, preheating of the first supply water is carried out with the aid of thermal energy acquired from the flue gases of the boiler in the first economizer section (20$a_1$), preheating (14) the supply water between the economizer sections (20$a_1$, 20$a_2$), wherein the preheating of the supply water is carried out with the aid of thermal energy acquired from the bled steams either directly or indirectly, wherein the supply water preheated with the aid of bled steams is conducted to the second economizer section (20$a_2$) and further, to a vaporizer (190) and a superheater (120) and, further in the form of steam, to the steam turbine (11) for rotating the electric generator (G) and for producing electricity, raising the temperature of the supply water continuously as it is flowing in the first economizer section (20$a_1$) and from the first economizer section (20$a_2$) to the preheating section (14), and from said preheating section (14) to the second economizer section (20$a_2$) with hotter supply water, preheating combustion air with the aid of energy acquired from bled steams, and controlling the temperature of the supply water in a connector (19) by controlling the bled-steam flow made to flow to the supply water preheater (14), wherein the bled steam flow to the preheater (14) is controlled on a basis of the temperature measurements, that is, by measuring a temperature ($T_1'$, $T_2'$) of the flue gases made to flow in a flue-gas duct (10$a$) and/or a supply water temperature ($T_1'$, $T_2'$) in the connector (19).

4. The method according to claim 3, wherein the flow quantity of bled stream in another connector (13$a_{1.1}$) is controlled with a valve (21).

* * * * *